US010693246B2

(12) United States Patent
Dix et al.

(10) Patent No.: US 10,693,246 B2
(45) Date of Patent: Jun. 23, 2020

(54) TERMINAL ASSEMBLY FOR USE WITH CONDUCTORS OF DIFFERENT SIZES AND METHOD OF ASSEMBLING

(71) Applicant: Lear Corporation, Southfield, MI (US)

(72) Inventors: Brandon H. Dix, Livonia, MI (US); Salim A. Marouf, Ypsilanti, MI (US); Priyal N. Sheth, Dearborn, MI (US); Arindam Banerjee, Dearborn, MI (US); Sneha Agasthya, Dearborn, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 16/107,080

(22) Filed: Aug. 21, 2018

(65) Prior Publication Data

US 2020/0067208 A1 Feb. 27, 2020

(51) Int. Cl.
*H01R 4/18* (2006.01)
*H01R 43/048* (2006.01)

(52) U.S. Cl.
CPC ..... *H01R 4/184* (2013.01); *H01R 4/185* (2013.01); *H01R 43/048* (2013.01); *H01R 43/0488* (2013.01)

(58) Field of Classification Search
CPC ..... H01R 4/184; H01R 43/048; H01R 4/185
USPC ..... 439/865–868, 870–882; 174/84 C; 29/863
See application file for complete search history.

(56) References Cited

U.S. PATENT DOCUMENTS 2,157,007 A 5/1939 Maximilian
3,510,824 A 5/1970 Corns
3,875,662 A 4/1975 Folk
4,142,771 A * 3/1979 Barnes ..... H01R 4/184 174/84 C
4,246,771 A 1/1981 Covill et al.
4,831,727 A 5/1989 Johnson, Jr. et al.
4,890,384 A 1/1990 Shaffer
(Continued)

FOREIGN PATENT DOCUMENTS

JP 2009021038 A 1/2009
JP 2017111883 A 6/2017
JP 2017174689 A 9/2017

OTHER PUBLICATIONS

Co-pending U.S. application, Dix, et al., U.S. Appl. No. 16/107,445, filed Aug. 21, 2018.
(Continued)

*Primary Examiner* — Travis S Chambers
(74) *Attorney, Agent, or Firm* — Fishman Stewart PLLC

(57) ABSTRACT

A terminal includes a terminal body and/or a first wing that may extend from the terminal body. The first wing that may have an end portion, a middle portion and/or a connecting portion. The inner surface of the end portion may be in contact with an inner surface of the middle portion. A terminal may include a second wing that may extend from the terminal body. An outer surface of the middle portion of the first wing may contact an outer surface of the middle portion of the second wing. A first wing and a second wing may be disposed on opposite sides of the terminal body. The second wing may include an end portion, a middle portion, and/or a connecting portion. A connecting portion of the first wing and a connecting portion of the second wing may both connect to the terminal body.

20 Claims, 13 Drawing Sheets

(56) References Cited

U.S. PATENT DOCUMENTS 5,025,554 A 6/1991 Dohi
5,357,669 A 10/1994 Orphanos et al.
5,486,653 A 1/1996 Dohi
5,561,267 A * 10/1996 Fudoo ..... H01R 4/185 174/84 C
5,733,154 A 3/1998 Libregts
6,059,616 A 5/2000 Bluemmel et al.
6,109,088 A 8/2000 Schrader et al.
6,334,798 B1 1/2002 Ushijima et al.
6,989,491 B2 1/2006 Triantopoulos et al.
7,044,813 B2 5/2006 Amara et al.
7,402,751 B2 7/2008 Haberman
7,775,842 B2 8/2010 Yamagami
7,803,008 B2 * 9/2010 Onuma ..... H01R 43/048 439/442
7,828,612 B2 * 11/2010 Kumakura ..... H01R 4/185 439/877
8,196,288 B2 6/2012 Wagner et al.
8,210,884 B2 7/2012 Corman et al.
8,221,171 B2 * 7/2012 Ono ..... H01R 4/185 439/877
8,827,754 B2 9/2014 Lee et al.
8,827,756 B2 9/2014 Mueller
8,869,584 B2 10/2014 Sokol
8,900,021 B2 12/2014 Sulek et al.
9,039,467 B2 5/2015 Seipel et al.
9,787,003 B2 10/2017 Kamoshida et al.
9,853,368 B2 12/2017 Myer et al.
2005/0257592 A1 11/2005 Baker et al.
2008/0081520 A1 * 4/2008 Myer ..... H01R 13/04 439/877
2010/0144217 A1 * 6/2010 Kumakura ..... H01R 4/185 439/877
2010/0230160 A1 * 9/2010 Ono ..... H01R 4/185 174/84 C
2013/0217279 A1 8/2013 Hemond et al.
2014/0322993 A1 * 10/2014 Ito ..... H01R 4/182 439/877
2014/0378011 A1 * 12/2014 Aizawa ..... H01R 4/185 439/877
2015/0074990 A1 * 3/2015 Bluemmel ..... H01R 43/048 29/753
2015/0303603 A1 10/2015 Hemond et al.
2015/0364833 A1 12/2015 Tonoike et al.
2016/0087350 A1 * 3/2016 Yamaji ..... H01R 4/62 439/877
2016/0240937 A1 8/2016 Matsuo
2016/0372881 A1 * 12/2016 Bauer ..... H01R 4/187
2017/0018858 A1 * 1/2017 Ohnuma ..... H01R 4/185

OTHER PUBLICATIONS

Co-pending U.S. application, Dix, et al., U.S. Appl. No. 16/107,578, filed Aug. 21, 2018.
Co-pending U.S. application, Dix, et al., U.S. Appl. No. 16/107,631, filed Aug. 21, 2018.

* cited by examiner

TERMINAL ASSEMBLY FOR USE WITH CONDUCTORS OF DIFFERENT SIZES AND METHOD OF ASSEMBLING

TECHNICAL FIELD

The present disclosure generally relates to terminals and terminal assemblies, including electrical terminals that may be used in connection with electrical wires or cables.

BACKGROUND

This background description is set forth below for the purpose of providing context only. Therefore, any aspect of this background description, to the extent that it does not otherwise qualify as prior art, is neither expressly nor impliedly admitted as prior art against the instant disclosure.

Some terminal assemblies may be relatively complex to use and/or to assemble. For example, connecting a terminal with some electrical conductors may involve a complex process and may include many different steps and components. Some terminals may not be configured for use with conductors of different sizes, so different types of terminals may be used for various sizes of conductors.

There is a desire for solutions/options that minimize or eliminate one or more challenges or shortcomings of terminals, electrical terminals, and/or terminal assemblies. The foregoing discussion is intended only to illustrate examples of the present field and should not be taken as a disavowal of scope.

SUMMARY

The foregoing and other aspects, features, details, utilities, and/or advantages of embodiments of the present disclosure will be apparent from reading the following description, and from reviewing the accompanying drawings.

In embodiments, a terminal may comprise a terminal body and/or a first wing that may extend from the terminal body. The first wing may have an end portion, a middle portion and/or a connecting portion. The inner surface of the end portion may be in contact with an inner surface of the middle portion. A terminal may include a second wing that may extend from the terminal body. An outer surface of the middle portion of the first wing may contact an outer surface of the middle portion of the second wing. A first wing and a second wing may be disposed on opposite sides of the terminal body. The second wing may include an end portion, a middle portion, and/or a connecting portion. A connecting portion of the first wing and a connecting portion of the second wing may both connect to the terminal body. A first wing, a second wing, and a terminal body may form a substantially closed first channel.

With embodiments, a terminal may include a third wing and/or a fourth wing. The third wing, the fourth wing, and/or the terminal body may form a substantially closed second channel. The first channel and the second channel may both extend substantially along a longitudinal axis. A connecting portion of the first wing and a connecting portion of the second wing may be disposed apart at a first distance. A connecting portion of the third wing and a connecting portion of the fourth wing may be disposed apart at a second distance. The first distance may be less than the second distance.

In embodiments, a terminal may include a first wing, second wing, and/or terminal body that may be configured to retain at least a portion of a conductor. The terminal may include a third wing, a fourth wing, and/or a terminal body portion that may be configured to retain at least a portion of an insulator. The insulator may be connected to the conductor.

With embodiments, an electrical assembly may comprise an electrical wire, a terminal body, and/or a plurality of wings. The plurality of wings may include a first wing and/or a second wing. The first wing may include a first bent portion and/or the second wing may include a second bent portion. In embodiments, at least one of the first bent portion and/or the second bent portion may be crimped with an electrical wire. The first wing may define a first gap, the second wing may define a second gap, and/or no portion of the electrical wire may be disposed within the first gap and/or the second gap. The first wing and the second wing may be in electrical contact with the electrical wire. A plurality of wings may include a third wing and/or a fourth wing. In embodiments, the third wing and the fourth wing may be offset from each other in a longitudinal direction, and/or the third wing and the fourth wing may retain an insulator of the electrical wire.

In embodiments, a method of assembling a terminal assembly may comprise providing a terminal including a terminal body, a first wing, and/or a second wing. The first wing and the second wing may each include an end portion, a middle portion, and/or a connecting portion. A method of assembling a terminal assembly may include bending an end portion of a first wing and/or an end portion of a second wing to provide a first bent portion and/or a second bent portion. The method may include crimping a first bent portion and a second bent portion onto a wire. The method may include bending an end portion of the first wing and/or an end portion of the second wing via a bending die. A bending die may have a plurality of recesses. A bending die may include a substantially flat bridge portion which may be disposed between a first recess and a second recess of a plurality of recesses. The recesses may be substantially oval-shaped. The first recess and/or the second recess may include a first portion and/or a second portion. The first portion of the first recess may contact an end portion of a first wing during bending, and/or the second portion of the second recess may contact an end portion of a second wing during bending. A method of assembling a terminal assembly may include a terminal having a third wing and/or a fourth wing. The third wing and the fourth wing may each include an end portion, a middle portion, and/or a connecting portion.

DETAILED DESCRIPTION

Figure 1B:
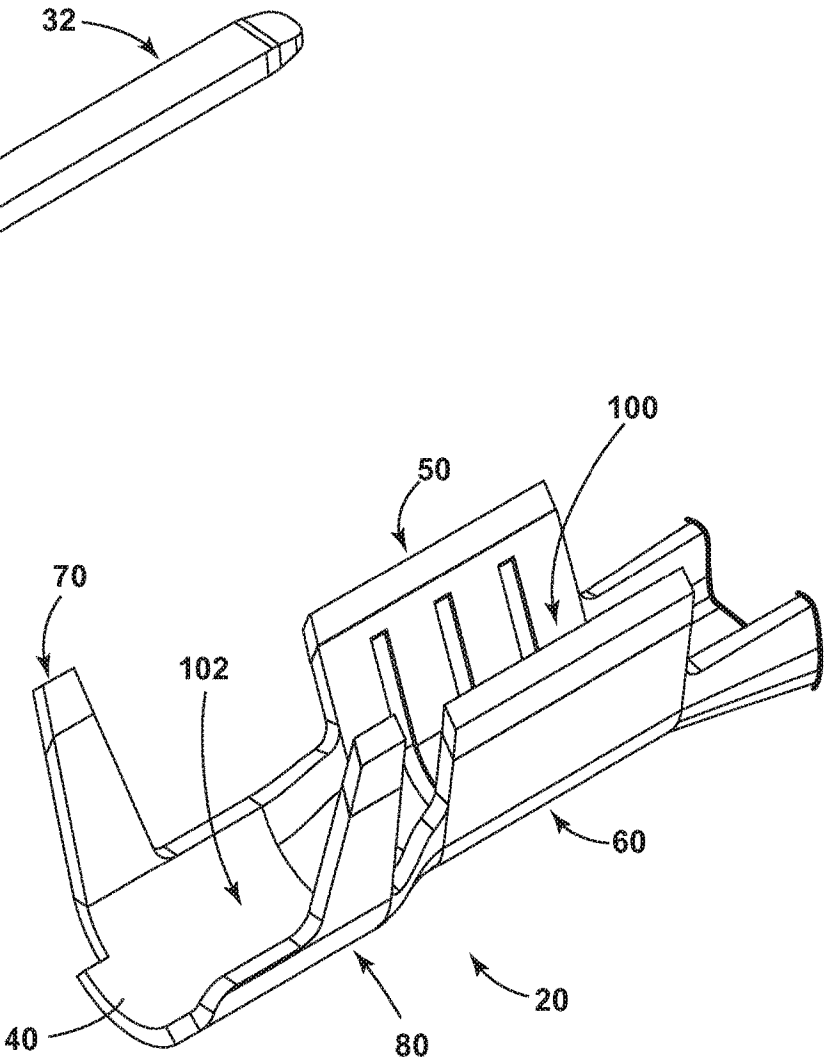
FIG. 1B is a perspective view generally illustrating portions of an embodiment of a terminal.
Figure 1A:
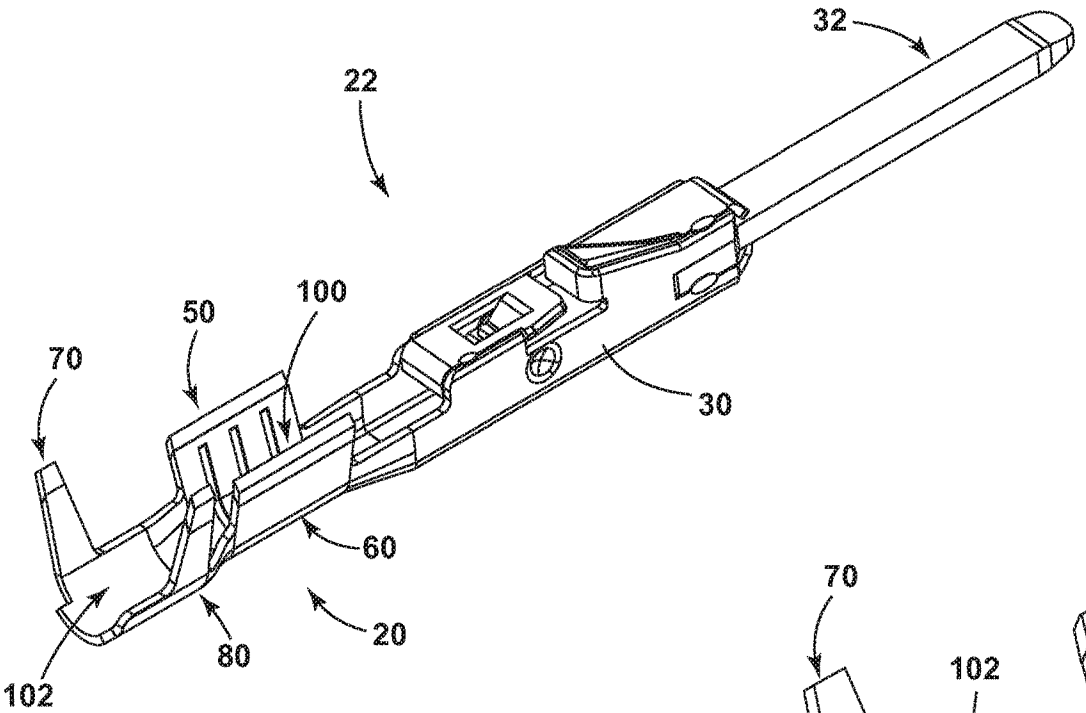
FIG. 1A is a perspective view generally illustrating an embodiment of a terminal assembly.
Figure 1C:
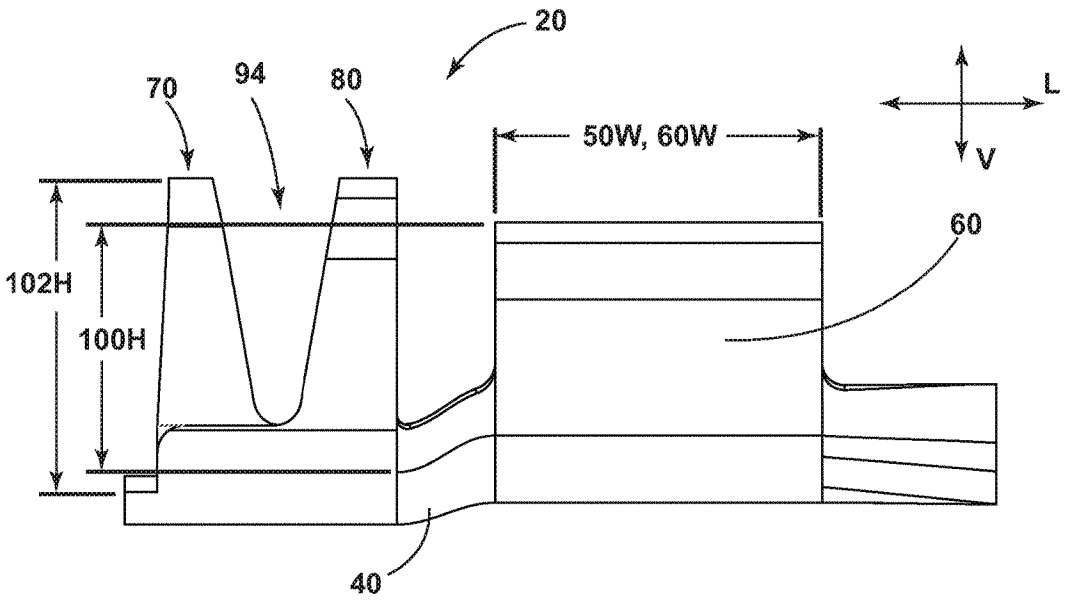
FIG. 1C is a side view generally illustrating portions of an embodiment of a terminal.
Figure 1D:
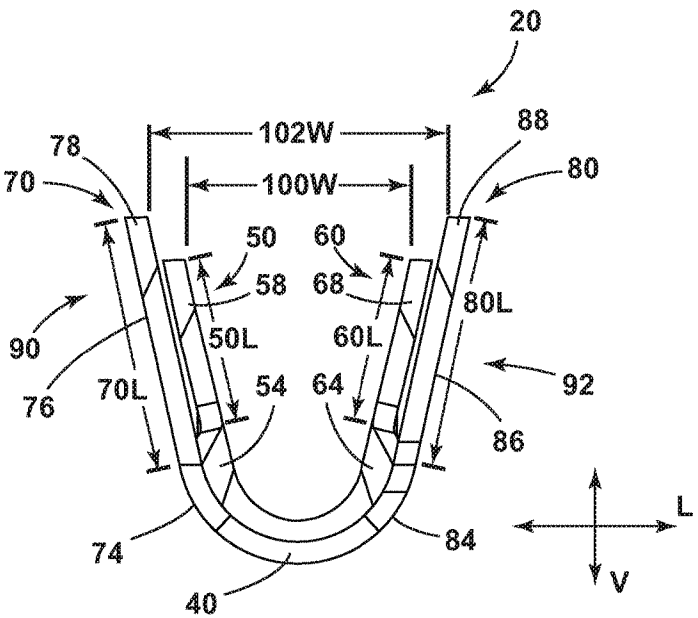
FIG. 1D is a cross-sectional view generally illustrating an embodiment of a terminal.
Figure 1E:
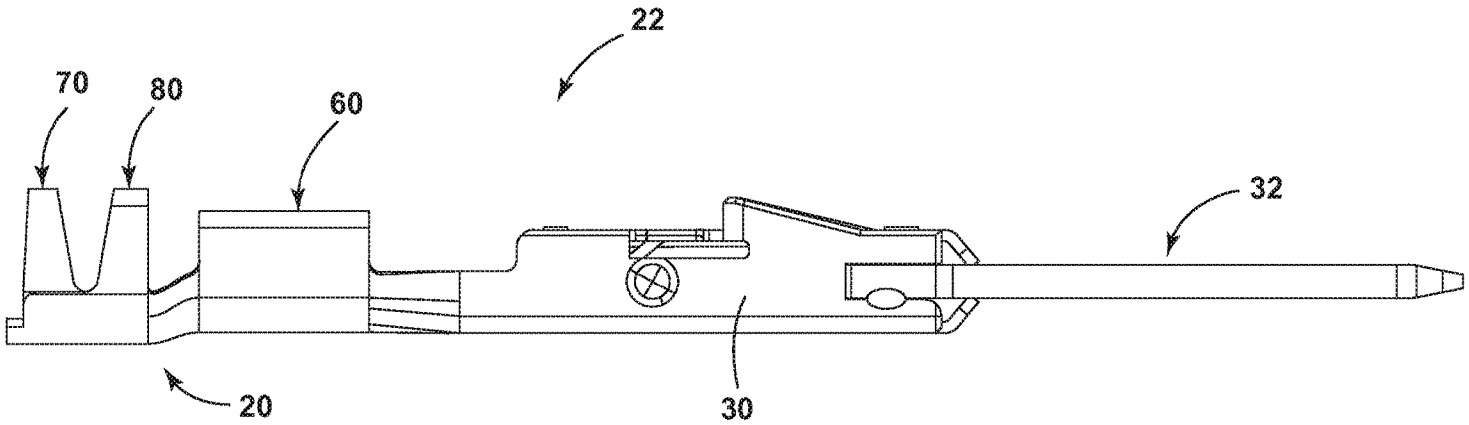
FIG. 1E is a side view generally illustrating an embodiment of a terminal assembly.
Figure 1F:
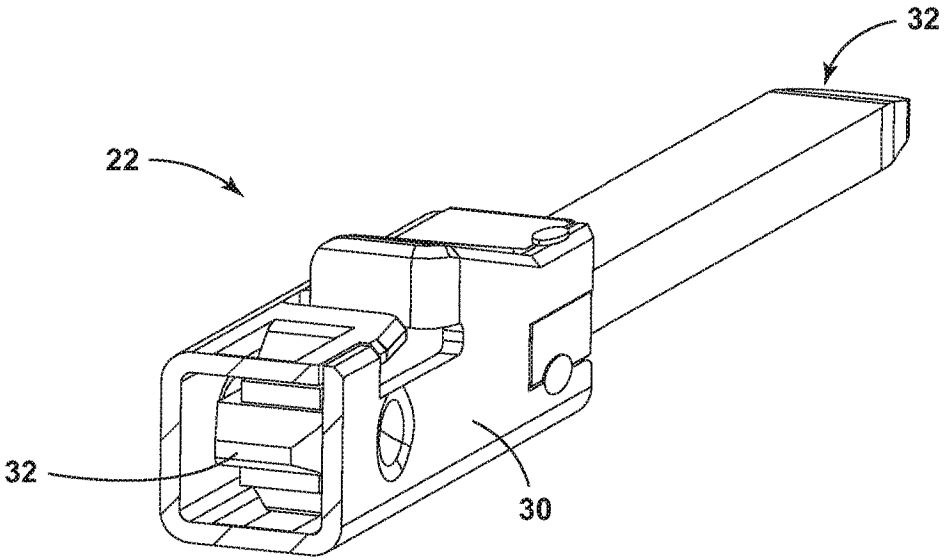
FIG. 1F is a cross-sectional perspective view generally illustrating an embodiment of a terminal assembly.

Reference will now be made in detail to embodiments of the present disclosure, examples of which are described herein and illustrated in the accompanying drawings. While the present disclosure will be described in conjunction with embodiments and/or examples, it will be understood that they are not intended to limit the present disclosure to these embodiments and/or examples. On the contrary, the present disclosure is intended to cover alternatives, modifications, and equivalents.

In embodiments, such as generally illustrated in FIGS. 1A, 1B, 1C, 1D, 1E, and 1F, a terminal assembly 22 may include a terminal 20 and a wire 24. The terminal 20 may include and/or be connected to a receiving portion 30. The receiving portion 30 may be configured to receive a male terminal or pin 32. The wire 24 may include a conductor 26 and an insulator 28 (e.g., see FIG. 9A). The insulator 28 may be connected to and/or at least partially surround the conductor 26. With embodiments, the terminal 20 may be configured to retain a wire 24. The terminal 20 may include a terminal body portion 40, a first wing 50, and/or a second wing 60. A terminal 20 may include one or more of a variety of shapes, sizes, and/or configurations. For example and without limitation, the terminal 20 may be substantially U-shaped and/or V-shaped.

In embodiments, a terminal body portion 40, a first wing 50, and/or a second wing 60 may include a respective inner surface and an outer surface. The terminal wings 50, 60 may be substantially planar. With embodiments, the terminal 20 may include a third wing 70 and/or a fourth wing 80. The first wing 50, the second wing 60, the third wing 70, and/or the fourth wing 80 may extend outward (e.g., vertically and/or laterally) from the terminal body portion 40. The first wing 50, the second wing 60, the third wing 70, and/or the fourth wing 80 may or may not extend at substantially the same angle (e.g., oblique and/or right angles) from the terminal body 40. The first wing 50 and the second wing 60 may extend at the same angle in opposite directions relative to the vertical direction.

With embodiments, the first wing 50 and the third wing 70 may extend from a first side 90 of the terminal body portion 40, and/or the second wing 60 and the fourth wing 80 may extend from a second side 92 of the terminal body portion 40. In embodiments, the first wing 50 and the second wing 60 may be disposed opposite each other, and/or the third wing 70 and the fourth wing 80 may be disposed opposite each other. With embodiments, the first wing 50 and the second wing 60 may extend generally in a vertical direction V and may include lengths 50L, 60L, which may or may not be the same. The third wing 70 and the fourth wing 80 may extend generally in the vertical direction V and include lengths 70L, 80L, which may or may not be the same. The lengths 50L, 60L may be different than the lengths 70L, 80L (e.g., shorter or longer). In embodiments, the first wing 50 and the second wing 60 may include widths 50W, 60W (e.g., relative to a longitudinal direction L), which may or may not be the same.

In embodiments, the third wing 70 and/or the fourth wing 80 may be offset (e.g., not disposed directly across from each other). For example and without limitation, the third wing 70 may be disposed farther from the first wing 50 and/or the second wing 60 than the fourth wing 80. With embodiments, there may be a gap 94 (e.g., in the longitudinal direction) between the third wing 70 and the fourth wing 80.

With embodiments, the terminal body portion 40, first wing 50, and/or the second wing 60 may form a first channel 100. The terminal body portion 40, third wing 70, and/or the fourth wing 80 may form a second channel 102. With embodiments, the first channel 100 and/or the second channel 102 may be aligned (e.g., aligned in the longitudinal direction and/or the lateral direction). The first wing 50 and the second wing 60 may be configured to retain a conductor 26 of a wire 24. The third wing 70 and the fourth wing 80 may be configured to retain an insulator 28 of a wire 24.

In embodiments, the first channel 100 may include a width 100W and the second channel 102 may include a width 102W (e.g., width in a lateral direction of the terminal 20). The first channel width 100W may be less than the second channel width 102W. With embodiments, the first channel 100 may include a first height 100H (e.g., in the vertical direction), and the second channel may include a second height 102H (e.g., in the vertical direction). The second height 102H may be greater than the first height 100H when measured from the same vertical position of the terminal 20 (e.g., at or about end portions 58, 68, 78, 88).

Figure 5C:
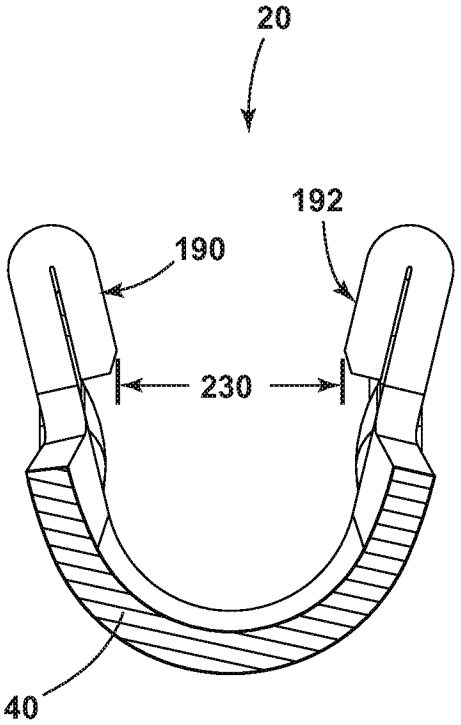
FIGS. 5A, 5B, and 5C are cross-sectional views generally illustrating embodiments of terminals after bending.
Figure 5B:
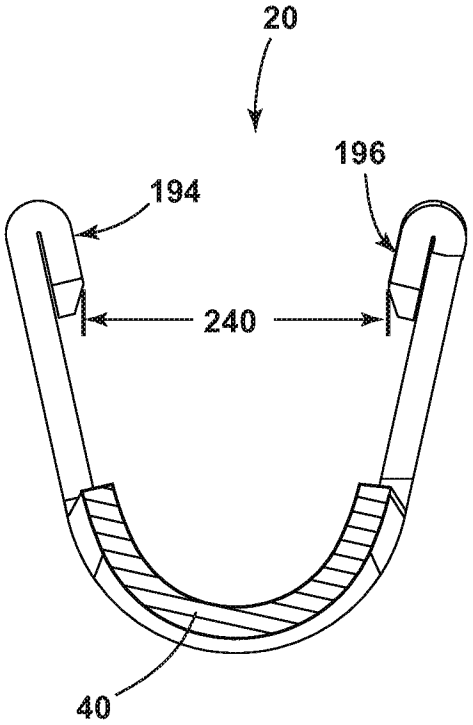
Figure 5A:
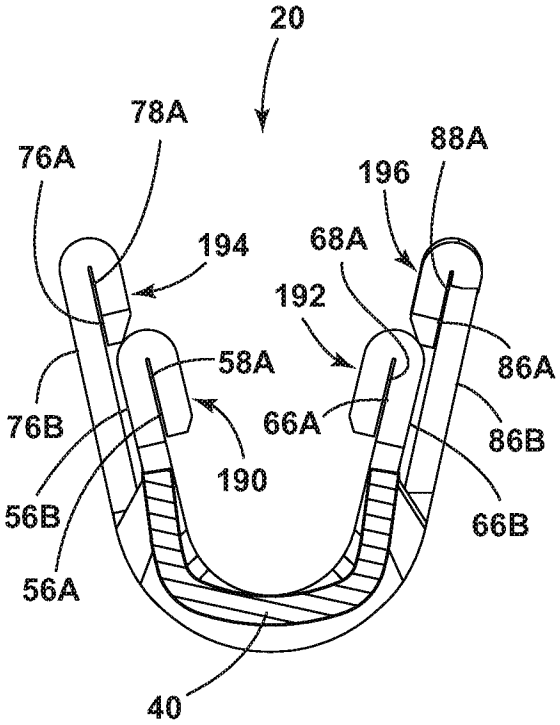

In embodiments, the wings 50, 60, 70, 80 may each include an end portion 58, 68, 78, 88, a middle portion 56, 66, 76, 86, and/or a connecting portion 54, 64, 74, 84. The end portions 58, 68, 78, 88 may include inner surfaces 58A, 68A, 78A, 88A (see, e.g., FIG. 5A). The middle portions may include inner surfaces 56A, 66A, 76A, 86A and/or outer surfaces 56B, 66B, 76B, 86B. The connecting portion 54, 64, 74, 84 may connect the wings 50, 60, 70, 80 to the terminal body 40. The middle portion 56, 66, 76, 86 of the wings 50, 60, 70, 80 may connect the connecting portions 54, 64, 74, 84 to the end portions 58, 68, 78, 88.

Figure 2:
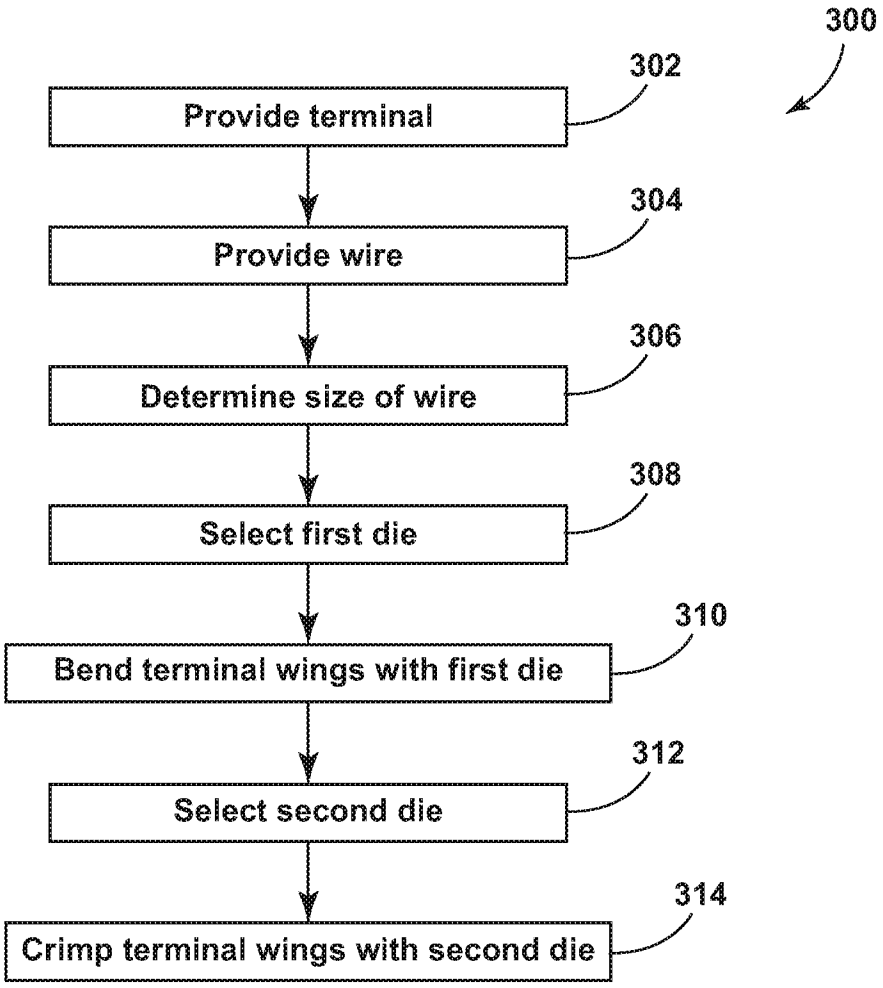
FIG. 2 is a flowchart generally illustrating an embodiment of a method of assembling a terminal assembly.

In embodiments, such as generally illustrated in FIG. 2, a method 300 of assembling a terminal assembly 22 may include providing a terminal 20 (step 302), providing a wire 24 (step 304), determining the size of the wire 24 (step 306), selecting a first/bending die 130 (step 308), bending one or more of the terminal wings 50, 60, 70, 80 with the first die 130 (step 310), selecting a second/crimping die 170 (step 312), and/or crimping one or more of the terminal wings 50, 60, 70, 80 via the second die 170 (step 314). Crimping one or more of the terminal wings 50, 60, 70, 80 may include crimping the first wing 50 and the second wing 60 with a conductor 26 of the wire 24 and/or crimping the third wing 60 and the fourth wing 80 with the insulator 28 of the wire.

In embodiments, the terminal 20 may include a first state, a second state, and/or a third state. In the first state, the terminal 20 may not be crimped, shortened, altered, and/or bent (see, e.g., FIGS. 1A-1F). In the second state, at least a portion of the terminal 20 may be bent (see, e.g., FIGS. 3C-5C). For example and without limitation, the end portions 58, 68, 78, 88 of the first wing 50, the second wing 60, the third wing 70, and/or the fourth wing 80 may be bent inwards towards a center of the terminal body portion 40. In the third state, the terminal 20 may be crimped onto a wire 24 (see, e.g., FIGS. 7A-8C). In embodiments, a first die 130 may be configured to bend a portion of the terminal 20. The terminal 20 may transition from the first state to the second state via the first die 130. A second die 170 may crimp the terminal 20. With embodiments, the terminal 20 may transition from the second state to the third state via the second die 170.

With embodiments, the wings 50, 60, 70, 80 may be bent such that the first channel 100 and/or the second channel 102 remain substantially open. The channels 100, 102 may be substantially open so that a wire 24 may be inserted (e.g., vertically from above the terminal 20 or longitudinally) into the first and/or second channel 100, 102. In a bent state, the inner surfaces of the end portions 58, 68, 78, 88 of the wings 50, 60, 70, 80 may be in contact with the inner surface of the middle portion 56, 66, 76, 86 of the wings 50, 60, 70, 80. For example and without limitation, the entire inner surfaces of the end portions 58, 68, 78, 88 may be in contact with the middle portions 56, 66, 76, 86 and/or the end portions may be substantially parallel with the middle portions 56, 66, 76, 86 (e.g., the end portions 58, 68, 78, 88 may be bent substantially 180 degrees relative to the middle portions 56, 66, 76, 86 and/or the connecting portions 54, 64, 74, 84.

In embodiments, such as generally illustrated in FIGS. 3A, 3B, 3C, 3D, and 3E, a method of bending the terminal 20 may include bending a terminal 20 via a first die 130 (e.g., a bending die). The first die 130 may include a top portion 131 and a bottom portion 132. The top portion 131 may be disposed substantially parallel to the bottom portion 132.

Figure 3C:
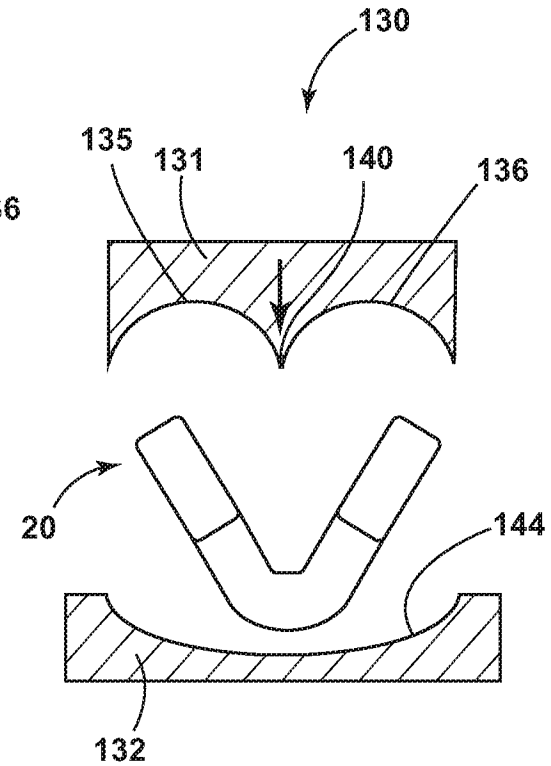
FIGS. 3A, 3B, and 3C are cross-sectional views generally illustrating embodiments of terminals and dies.
Figure 3B:
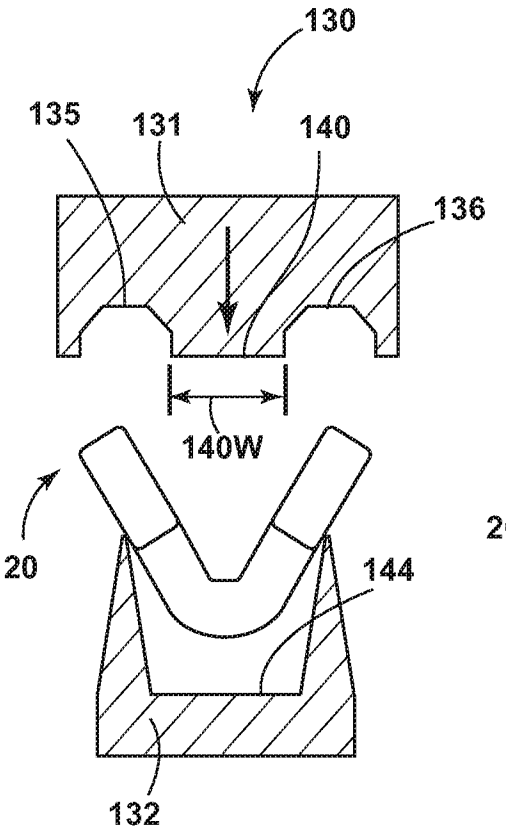
Figure 3A:
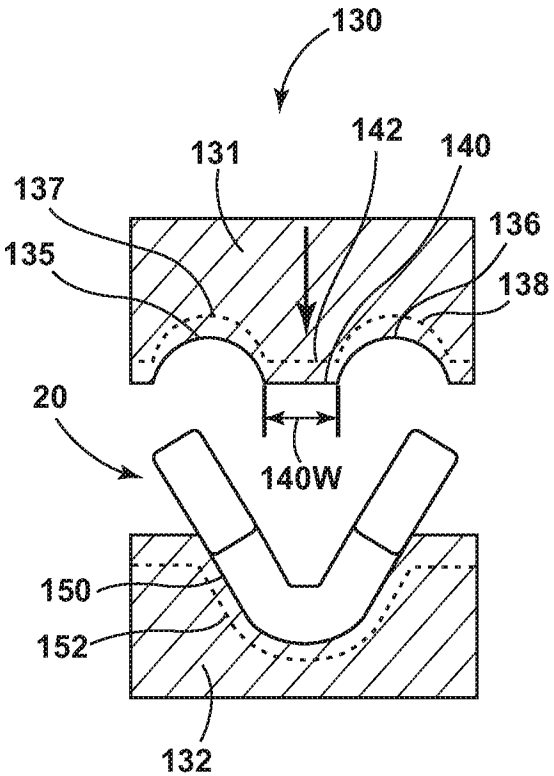
Figure 3E:
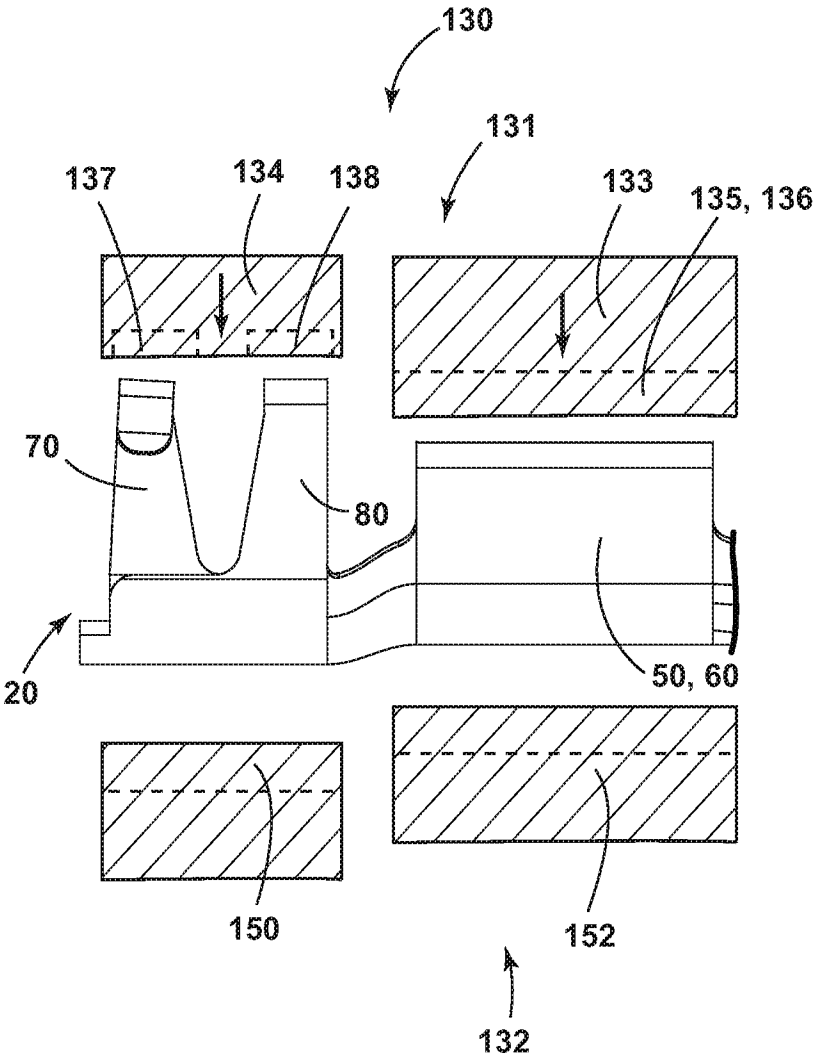
FIGS. 3D and 3E are side views generally illustrating portions of embodiments of terminals and dies.
Figure 3D:
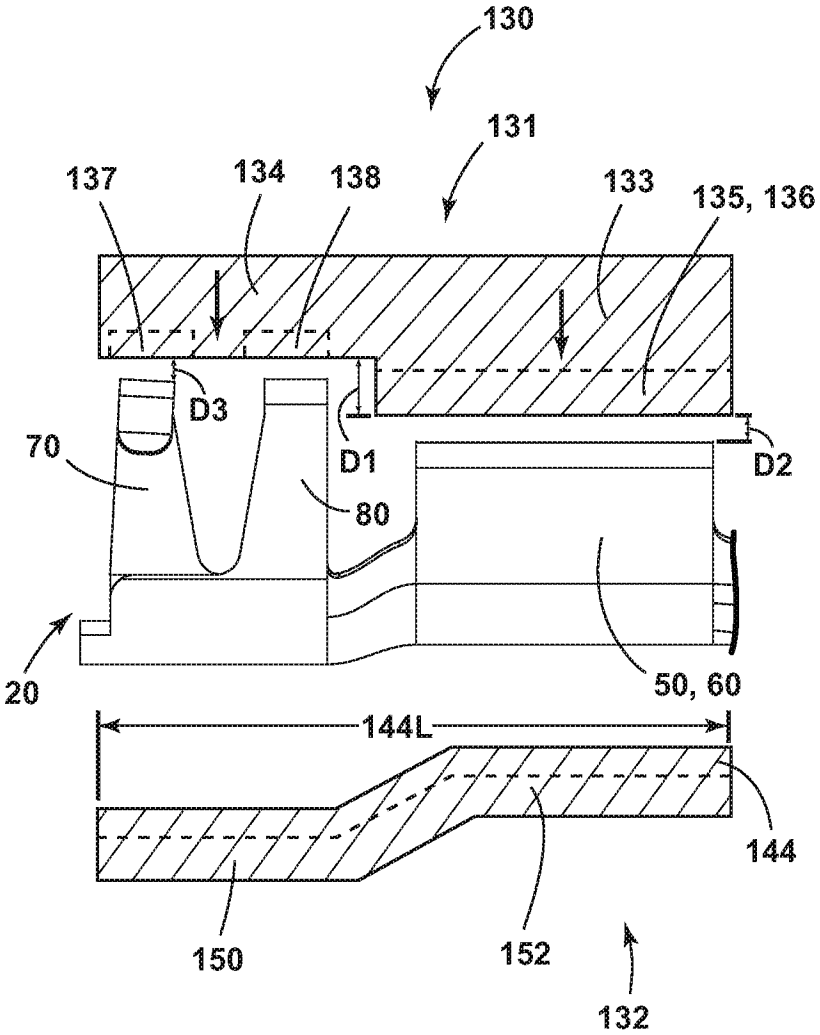
Figure 4A:
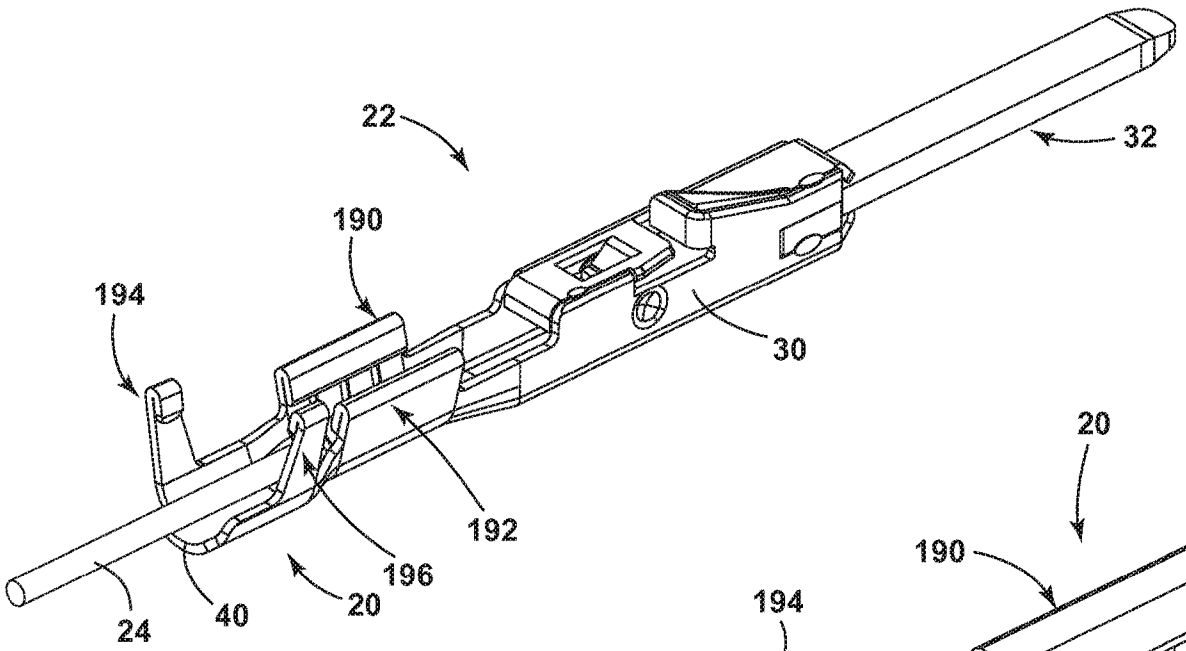
FIG. 4A is a perspective view generally illustrating an embodiment of a terminal assembly after bending.
Figure 4B:
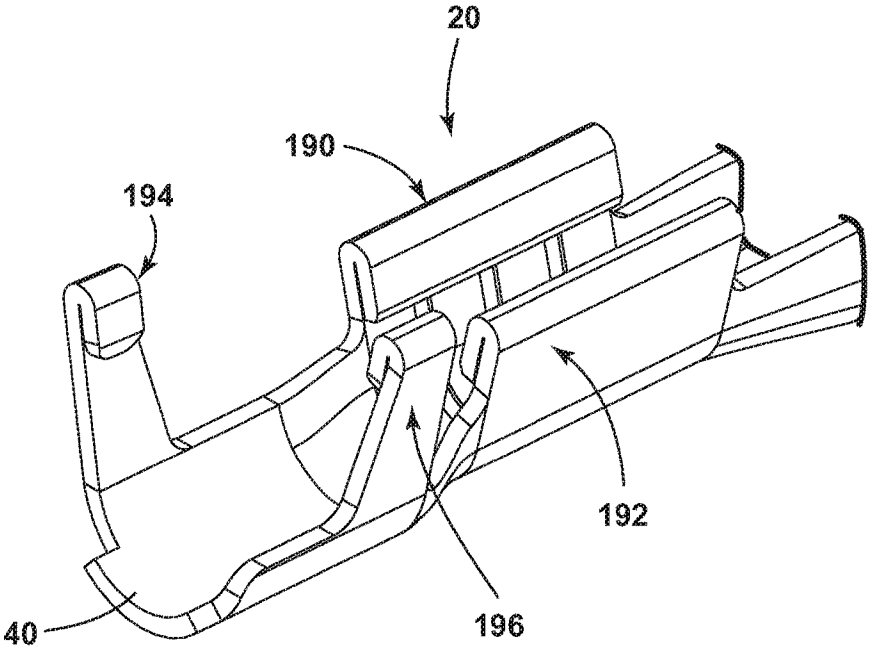
FIG. 4B is a perspective view generally illustrating portions of an embodiment of a terminal after bending.

With embodiments, the top portion 131 may be disposed proximate the end portions 58, 68, 78, 88 of the wings 50, 60, 70, 80. The bottom portion 132 may be disposed proximate the terminal body portion 40 and/or the connecting portions 54, 64, 74, 84 of the wings 50, 60, 70, 80. In embodiments, the top portion 131 of the first die 130 may include a conductor bending portion 133 and an insulator bending portion 134 (see, e.g., FIGS. 3D and 3E). As generally illustrated in FIG. 3D, the conductor bending portion 133 may be formed with the insulator bending portion 134 as a single piece. Alternatively, as generally illustrated in FIG. 3E, the conductor bending portion 133 may be independent from the insulator bending portion 134 (e.g., the conductor bending portion 133 and the insulator bending portion may be separate pieces that may be independently movable). In embodiments, the conductor bending portion 133 may be configured to bend the first wing 50 and the second wing 60, and/or the insulator bending portion 134 may be configured to bend the third wing 70 and the fourth wing 80. The conductor bending portion 133 may be vertically offset by a distance $D_1$ from the insulator bending portion 134, such as to compensate for different heights of the first wing 50 and the second wing 60 relative to the third wing 70 and the fourth wing 80. In an initial/non-bending position, a conductor bending portion 133 may be disposed at a distance $D_2$ from the first wing 50 and/or the second wing 60. In an initial/non-bending position, the insulator bending portion 134 may be disposed at a distance $D_3$ from the third wing 70 and/or fourth wing 80. Distances $D_2$, $D_3$ may be substantially the same.

With embodiments, a first die top portion 131 may include a first recess 135 and/or a second recess 136. In embodiments, the first recess 135 and/or a second recess 136 may receive at least a portion of the wings 50, 60, 70, 80. The first recess 135 and/or the second recess 136 may include one or more of a variety of shapes, sizes, and/or configurations. For example and without limitation, the first recess 135 and/or a second recess 136 may be substantially oval-shaped and/or generally rounded. The recesses 135, 136 may include a plurality of planar segments (see e.g. FIG. 3B) that may be disposed to form a generally rounded shape (e.g., a half circle-shaped and/or half oval-shaped). A first recess 135 and/or a second recess 136 may open outward and/or to a side of the first die 130. In embodiments, the first recess 135 and the second recess 136 may be configured to bend the end portions 58, 68 of the wings 50, 60 to create bent portions 190, 192.

In embodiments, the first die top portion 131 may include a third recess 137 and/or a fourth recess 138. The third recess 137 and the fourth recess 138 may be configured to bend the end portions 78, 88 of the wings 70, 80 (e.g., simultaneously) to create bent portions 194, 196. With embodiments, the first recess 135 may contact the first wing 50, the second recess 136 may contact the second wing 60, the third recess 137 may contact the third wing 70, and/or the fourth recess 138 may contact the fourth wing 80, simultaneously. The recesses 135, 136, 137, 138 may be substantially similar or the same shape and/or size. In embodiments, the first recess 135 and the second recess 136 may be disposed at a different distance from the terminal body portion 40 than the third recess 137 and the fourth recess 138. In embodiments, the first recess 135 and/or the second recess 136 may be formed into the same side (e.g., bottom side) of the top portion 131.

With embodiments, a top portion 131 of a first die 130 may include a first bridge portion 140 and/or a second bridge portion 142. The bridge portions 140, 142 may include one or more of a variety of shapes, sizes, and/or configurations. For example and without limitation, the bridge portions 140, 142 may have a substantially flat/planar bottom surface that may include a rectangular configuration or the bottom surface may be substantially pointed. With embodiments, the bridge portions 140, 142 may be disposed between recesses 135, 136, 137, 138. For example, the first bridge portion 140 may be disposed between (e.g., laterally) the first recess 135 and the second recess 136, and/or the second bridge 142 portion may be disposed between the third recess 137 and the fourth recess 138. The bridge portions 140, 142 may limit movement of the wings 50, 60, 70, 80 towards each other and/or the center of the terminal body portion 40 during bending, such as to facilitate insertion of a wire 24 into the first channel 100 and/or the second channel 102 after bending and prior to crimping. The first bridge portion 140 may include a width 140W (e.g., in a lateral direction) that may be less than a width 142W (e.g., in a lateral direction) of the second bridge portion 142. For example and without limitation, the widths 140W, 142W of the bridges 140, 142 may correspond to sizes of gaps 230, 240 between the wings 50, 60, 70, 80 (e.g., see FIGS. 5B and 5C). The first gap 230 may be between the bent portions 190, 192 of the first wing 50 and the second wing 60. The second gap 240 may be between the bent portions 194, 196 of the third wing 70 and the fourth wing 80. Greater widths 140W, 142W of the bridges 140, 142 may correlate to larger gaps 230, 240, and/or smaller widths 140W, 142W of the bridges 140, 142 may correlate to smaller gaps 230, 240.

In embodiments, the first die bottom portion 132 may include a channel 144. The channel 144 may include one or more of a variety of shapes, sizes, and/or configurations. For example and without limitation, the channel 144 may be substantially U-shaped, V-shaped, oval-shaped, and/or rounded. In embodiments, the channel 144 may retain a terminal 20 during bending. For example and without limitation, the channel 144 may retain the terminal body portion 40, at least some parts of one or more of the connecting portions 54, 64, 74, 84, and/or at least some parts of the middle portions 56, 66, 76, 86. The channel 144 may extend in a longitudinal direction, such as from a first end of the bottom portion 132 to a second end of the bottom portion 132. The first end may be opposite the second end. The channel 144 may include a length 144L (e.g., in the longitudinal direction) that may be longer or shorter than the terminal 20, or the length 144L may be substantially the same as a length of the terminal 20.

In embodiments, the channel 144 may include an insulator portion 152 and/or a conductor portion 150. The insulator portion 152 may be wider than the conductor portion 150. In embodiments, the insulator portion 152 may be configured to retain (e.g., restrict movement in at least one direction) the terminal body portion 40 at or about the third wing 70 and the fourth wing 80. The conductor portion 150 may be configured to retain the terminal body portion 40 at or about the first wing 50 and the second wing 60. With embodiments, such as generally illustrated in FIG. 3A, in an initial/pre-bending position of the terminal 20, the channel 144 may be configured to contact the terminal 20 along an inner surface of the channel 144 (e.g., substantially all of the inner surface). In other embodiments, such as generally illustrated in FIG. 3B, the channel 144 may be configured to contact the terminal 20 substantially along edges of the channel 144 (e.g., upper edges). In yet other embodiments, such as generally illustrated in FIG. 3C, the channel 144 may be wider than the terminal 20 and/or the terminal 20 may contact only portions of the inner surface of the channel 144.

In embodiments, such as generally illustrated in FIGS. 4A, 4B, 5A, 5B, and 5C, wings 50, 60, 70 80 may be bent to form bent portions 190, 192, 194, 196. A bending die top portion 131 may be pressed (e.g. in a downward direction) onto the terminal 20, such as while the bending die bottom portion 132 supports the terminal 20 from the opposite direction, to form bent portions 190, 192, 194, 196. The first recess 135 may contact the first wing 50 and/or the first recess 135 may bend the end portion 58 of the first wing 50 to form a first bent portion 190. Bending the first wing 50 may include bending the end portion 58 such that the end portion 58 contacts the middle portion 56 of the first wing 50. With embodiments, the second recess 136 may contact the second wing 60 and/or the second recess 136 may bend the end portion 68 of the second wing 60 to form a second bent portion 192. Bending the second wing 60 may include bending end portion 68 such that end portion 68 contacts the middle portion 66 of the second wing 60. The third recess 137 may contact the third wing 70 and/or the third recess 137 may bend the end portion 78 of the third wing 70 to form a third bent portion 194. Bending the third wing 70 may include bending the end portion 78 such that the end portion 78 contacts the middle portion 76 of the third wing 70. The fourth recess 138 may contact the fourth wing 80 and/or the fourth recess 138 may bend the end portion 88 of the fourth wing 80 to form a fourth bent portion 196. Bending the fourth wing 80 may include bending the end portion 88 such that the end portion 88 contacts the middle portion 86 of the fourth wing 80.

In embodiments, during bending, the end portions 58, 68, 78, 88 may first contact the outer portions of the recesses 135, 136, 137, 138. As the top portion 131 and the bottom portion 132 of the first die 130 move together, the end portions 58, 68, 78, 88 may move from contacting the outer portions to contacting the inner portions of the recesses 135, 136, 137, 138. With embodiments, as the end portions 58, 68, 78, 88 move from contacting the outer portions to contacting the inner portions, the first die 130 may cause the end portions 58, 68, 78, 88 to bend, resulting in bent portions 190, 192, 194, 196.

With embodiments, the bent portions 190, 192, 194, 196 may include the end portions 58, 68, 78, 88 of the wings 50, 60, 70, 80 contacting the respective middle portions 56, 66, 76, 86 of the wings 50, 60, 70, 80 such that some or all of the inner surfaces of the end portions 58, 68, 78, 88 may be in contact with inner surfaces of the middle portions 56, 66, 76, 86. With embodiments, during bending, the recesses 135, 136, 137, 138 may bend the end portions 58, 68, 78, 88 of the wings 50, 60, 70, 80 substantially 180 degrees such that the end portions 58, 68, 78, 88 are parallel with middle portions 56, 66, 76, 86. In embodiments, the bent portions 190, 192, 194, 196 may or may not include a space between the inner surfaces of the end portions 58, 68, 78, 88 and the middle portions 56, 66, 76, 86.

In embodiments, a third state of the terminal 20 may include the terminal 20 being crimped with a wire or cable, such as after bending. The terminal 20 may be crimped with a wire 24 via a second die 170. The second die 170 may include a top portion 171 and a bottom portion 172. The top portion 171 may be disposed substantially parallel to the bottom portion 172.

Figure 6A:
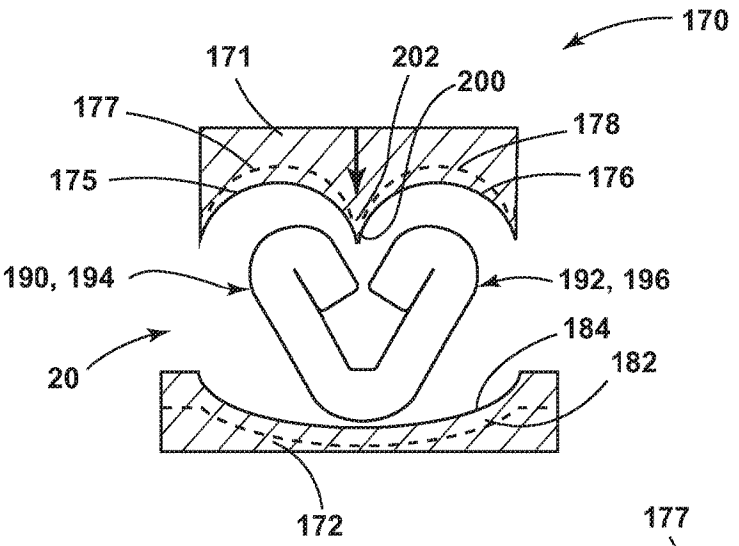
FIG. 6A is a cross-sectional view generally illustrating portions of an embodiment of a terminal and a die.
Figure 6B:
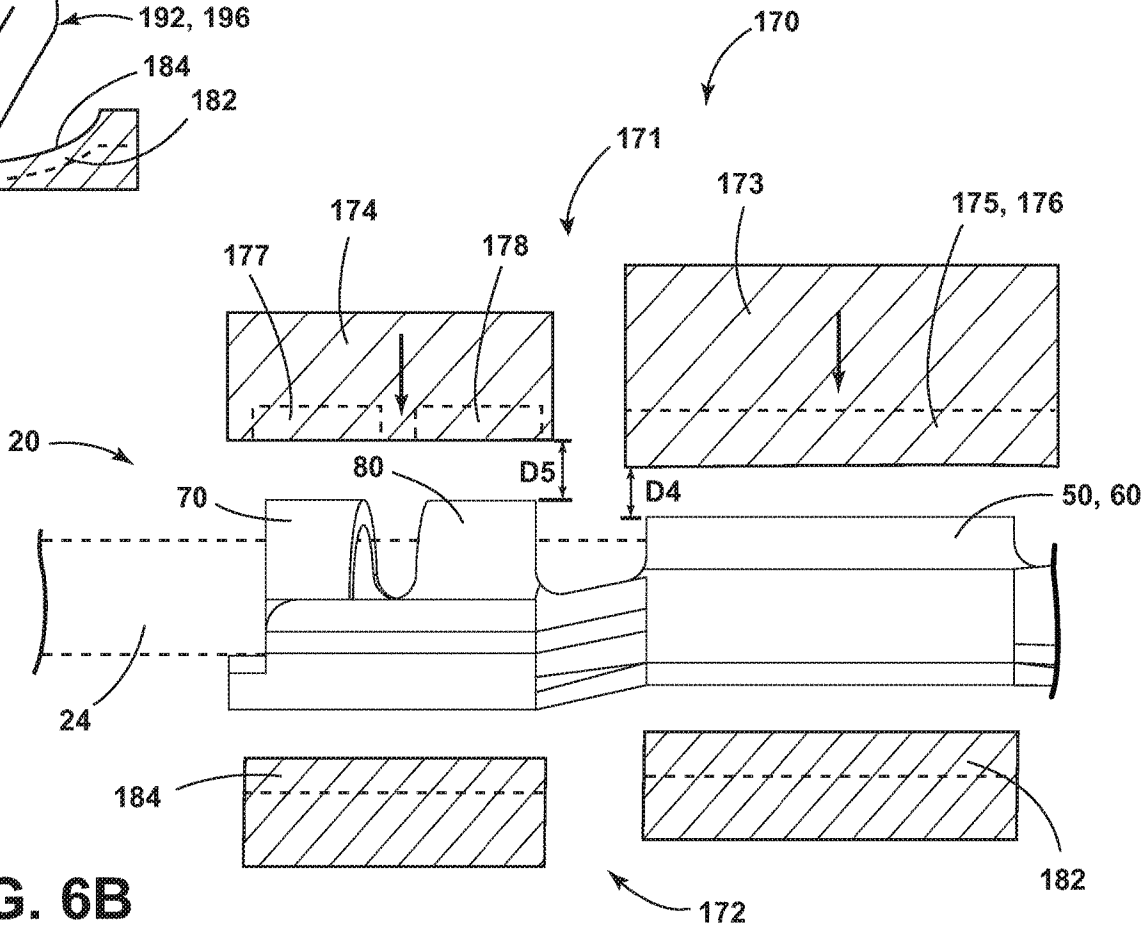
FIGS. 6B and 6C are side views generally illustrating embodiments of a terminal and a die.
Figure 6C:
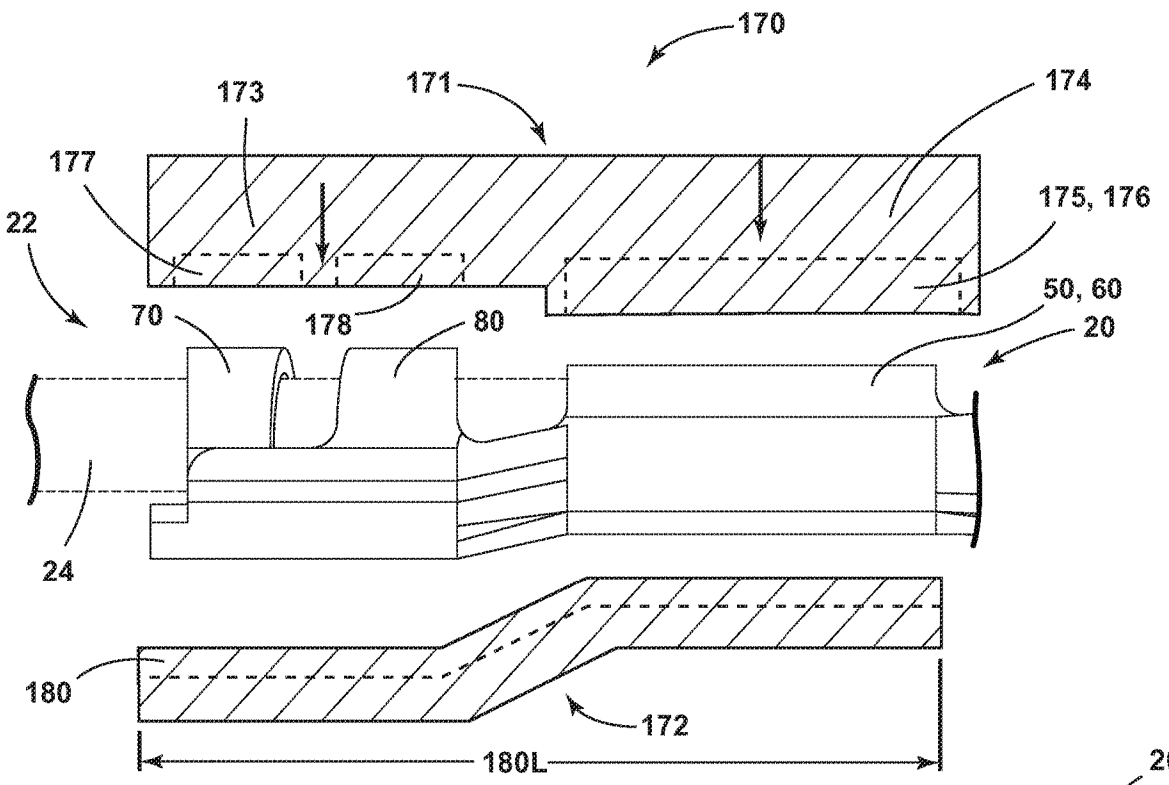

With embodiments, such as generally illustrated in FIGS. 6A, 6B, and 6C, the top portion 171 may be disposed proximate the bent portions 190, 192, 194, 196 of the wings 50, 60, 70, 80. The bottom portion 172 may be disposed proximate the terminal body portion 40 and/or the connecting portions 54, 64, 74, 84 of the wings 50, 60, 70, 80. In embodiments, the top portion 171 may include a conductor crimp portion 173 and an insulator crimp portion 174. The conductor crimp portion 173 may be formed with the insulator crimp portion 174 as a single piece. Alternatively, the conductor crimp portion 173 may be independent from the insulator crimp portion 174 (e.g., may be separate, independently movable pieces). The conductor crimp portion 173 may be disposed proximate the first bent portion 190 and the second bent portion 192. The insulator crimp portion 174 may be disposed proximate the third bent portion 194 and the fourth bent portion 196. A conductor crimp portion 173 may be disposed at a distance $D_4$ from the first bent portion 190 and second bent portion 192, and the insulator crimp portion 174 may be disposed at a distance $D_5$ from the third bent portion 194 and the fourth bent portion 196 (see, e.g., FIG. 6B). Distances $D_4$, $D_5$ may or may not be substantially the same.

With embodiments, the conductor crimp portion 173 may include a first recess 175, and/or a second recess 176. The conductor crimp portion 173 may include a first protrusion 200 between the first recess 175 and the second recess 176. The insulator crimp portion 174 may include a third recess 177 and/or a fourth recess 178. The insulator crimp portion 174 may include a second protrusion 202 that may be disposed between the third recess 177 and the fourth recess 178. The first protrusion 200 and the second protrusion 202 may include one or more of a variety of shapes, sizes, and/or configuration. For example and without limitation, the first and second protrusions 200, 202 may be substantially triangle-shaped and/or pointed.

In embodiments, the recesses 175, 176, 177, 178 may include one or more of a variety of shapes, sizes, and/or configurations. For example and without limitation, the recesses 175, 176, 177, 178 may be substantially oval-shaped, half circle-shaped, and/or generally rounded. The recesses 175, 176, 177, 178 may include a plurality of planar segments that may be disposed to form a generally rounded shape (e.g., a similar manner as generally illustrated in connection with first die top portion 131 in FIG. 3B). The recesses 175, 176, 177, 178 may be substantially similar to each other and may include substantially the same shape and/or size. In embodiments, the first recess 175 and the second recess 176 may be disposed at a different distance from the terminal body portion 40 (e.g., at a different height) than the third recess 177 and the fourth recess 178, such as to compensate for different lengths of the first wing 50 and the second wing 60 relative to the lengths of the third wing 70 and the fourth wing 80. The first recess 175 and the second recess 176 may be disposed at the same distance from the first bent portion 190 and the second bent portion 192 as the third recess 177 and the fourth recess 178 may be disposed from the third bent portion 194 and the fourth bent portion 196.

In embodiments, such as generally illustrated in FIGS. 6A, 6B, and 6C, the second die bottom portion 172 may include a channel 180. The channel 180 may include one or more of a variety of shapes, sizes, and/or configurations. For example and without limitation, the channel 180 may be substantially U-shaped, V-shaped, oval-shaped, and/or rounded. In embodiments, the channel 180 may retain a terminal 20 during crimping. For example and without limitation, the channel 180 may retain (e.g., limit movement in at least one direction) the terminal body portion 40 and/or the connecting portions of the first wing 50, second wing 60, third wing 70, and fourth wing 80. The channel 180 may extend in a longitudinal direction, such as from a first end of the bottom portion 172 to a second end of the bottom portion 172. The first end may be opposite the second end. The channel 180 may include a length 180L (e.g., in the longitudinal direction) that may be longer or shorter than the terminal 20, or the length 180L may be substantially the same as a length of the terminal 20.

In embodiments, the channel 180 may include an insulator portion 182 and/or a conductor portion 184. The conductor portion 184 may be wider than the insulator portion 182. In embodiments, the insulator portion 182 may be configured to retain (e.g., restrict movement in at least one direction) the terminal body portion 40 at or about the third wing 70 and the fourth wing 80. The conductor portion 184 may be configured to retain the terminal body portion 40 at or about the first wing 50 and the second wing 60. With embodiments, such as generally illustrated in FIG. 6A, in an initial/pre-crimping position of the terminal 20, the channel 180 may be configured to contact the terminal 20 along an inner surface of the channel 180 (e.g., substantially all of the inner surface). In embodiments, the channel 180 may be wider than the terminal 20 and the terminal may contact only portions of the inner surface of the channel 180.

Figure 7A:
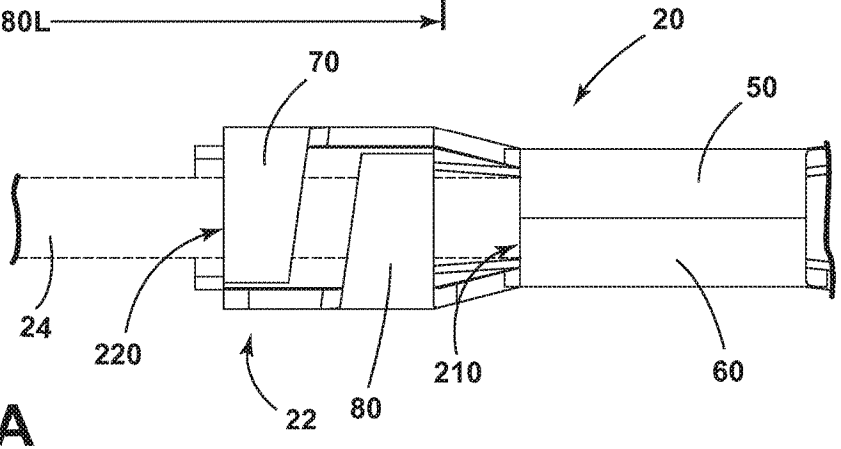
FIG. 7A is a top view generally illustrating portions of an embodiment of a terminal assembly after crimping.
Figure 7B:
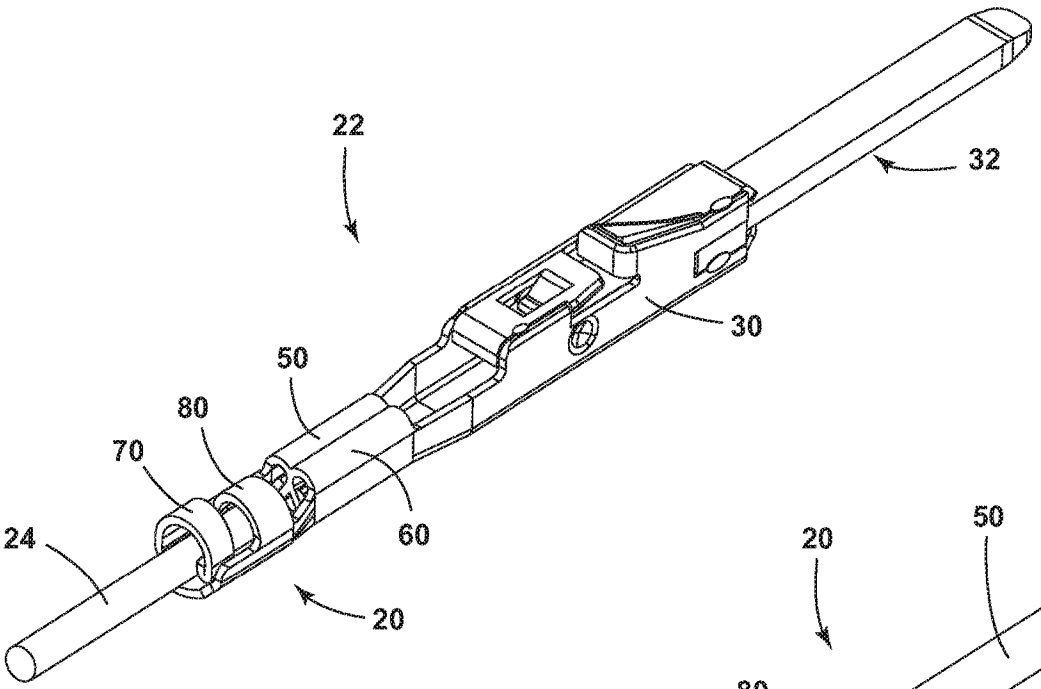
FIG. 7B is a perspective view generally illustrating an embodiment of a terminal assembly after crimping.
Figure 7C:
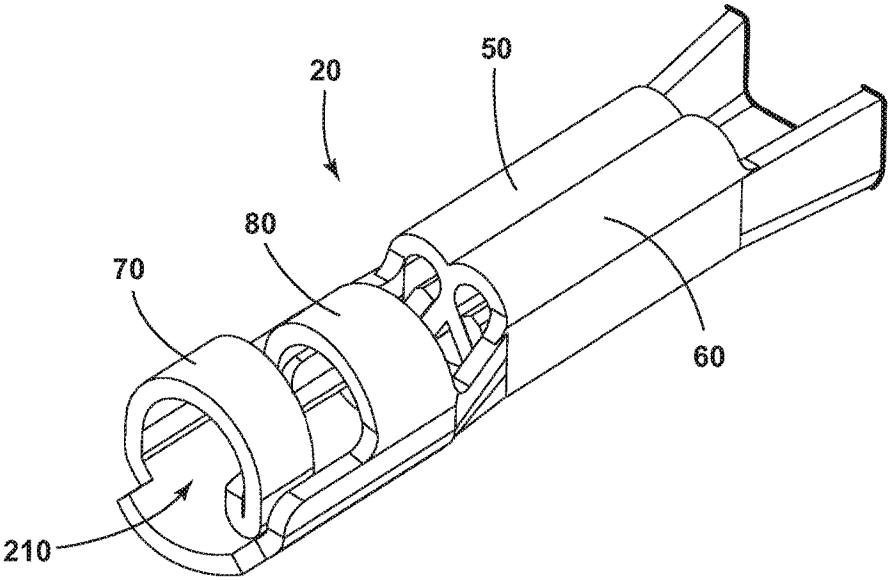
FIG. 7C is a perspective view generally illustrating portions of an embodiment of a terminal after crimping.

With embodiments, such as generally illustrated in FIGS. 7A, 7B, and 7C, in a third state of a terminal 20, an outer surface of the first bent portion 190 (e.g., an outer surface of the connecting portion 54, middle portion 56, and/or end portion 58) may be in contact with an outer surface of the second bent portion 192 (e.g., an outer surface of the connecting portion 64, middle portion 66, and/or end portion 68). An outer surface of the third bent portion 194 may or may not be in contact with an outer surface of the fourth bent portion 196. The third bent portion 194 and the fourth bent portion 196 may be offset longitudinally as to not contact each other in the third state.

In embodiments, a terminal 20 in a third state may include a channel 210 to retain (e.g., restrict movement in at least one direction) a conductor 26 of a wire. The channel 210 may be substantially closed and/or may be formed from the first wing 50 and/or second wing 60. The channel 210 may include one or more of a variety of shapes, sizes, and/or configurations. For example and without limitation, the channel 210 may be substantially triangular, circular, rectangular, or oval-shaped. In embodiments, the conductor 26 may be in contact with an outer surface of the end portions 58, 68 of the wings 50, 60, and/or the conductor 26 may be in contact with an inner surface of the terminal body portion 40, which may provide an electrical connection between the conductor 26 and the terminal 20. With embodiments, the connecting portions 54, 64 of the wings 50, 60 may be configured not to contact the conductor 26.

Figure 8C:
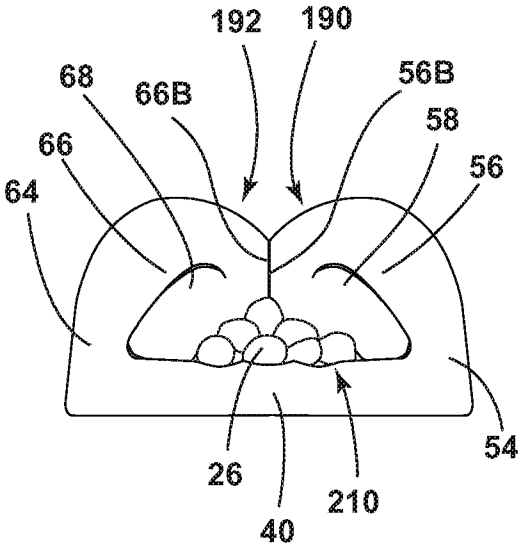
FIGS. 8A, 8B, and 8C are cross-sectional views generally illustrating embodiments of terminal assemblies after crimping.
Figure 8B:
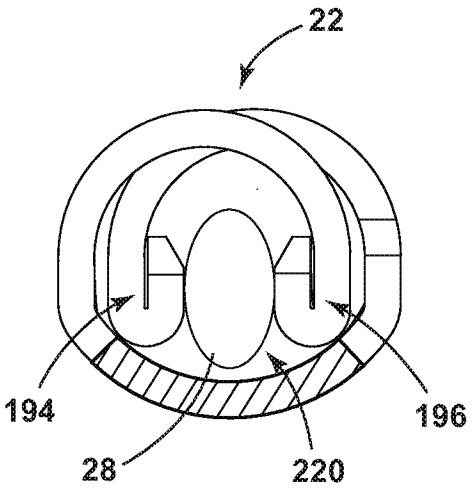
Figure 8A:
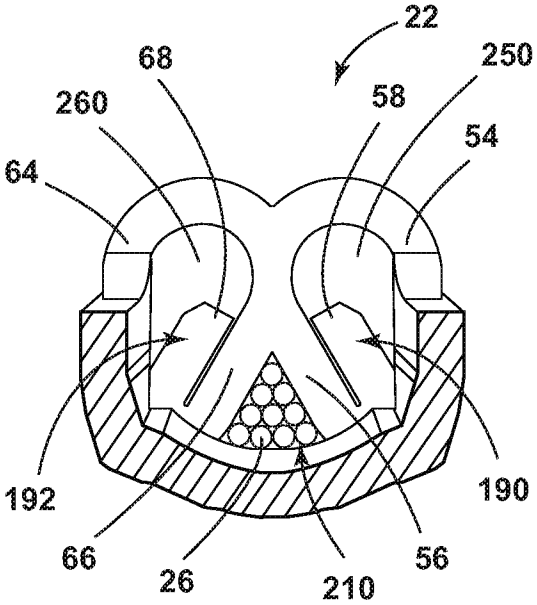

In embodiments, such as generally illustrated in FIGS. 8A, 8B, and 8C, a terminal 20 in a third state may include a channel 220 to retain (e.g., restrict movement in at least one direction) an insulator 28 of a wire 24. The channel 220 may be formed by the terminal body portion 40, the third wing 70, and/or the fourth wing 80. The terminal body portion 40, connecting portions 74, 84, middle portions 76, 86, and/or end portions 78, 88 of the third wing 70 and/or the fourth wing 80 may contact the insulator 28. With embodiments, only the third bent portion 194, the fourth bent portion 196, and/or the terminal body 40 may contact the insulator 28. The channel 210 retaining the conductor 26 may be aligned with the channel 220 retaining the insulator 28.

In embodiments, such as generally illustrated in FIG. 8A, a terminal 20 in the third state may include a third gap or chamber 250 and a fourth gap or chamber 260. The third gap 250 may be disposed between the first bent portion 190, the connecting portion 54, and/or the middle portion 56 of the first wing 50. The fourth gap 260 may be disposed between the second bent portion 192, the connecting portion 64, and/or the middle portion 66 of the second wing 60. In embodiments, the third state may not include gaps between the first wing 50, second wing 60, and/or the terminal body portion 40.

Figure 9B:
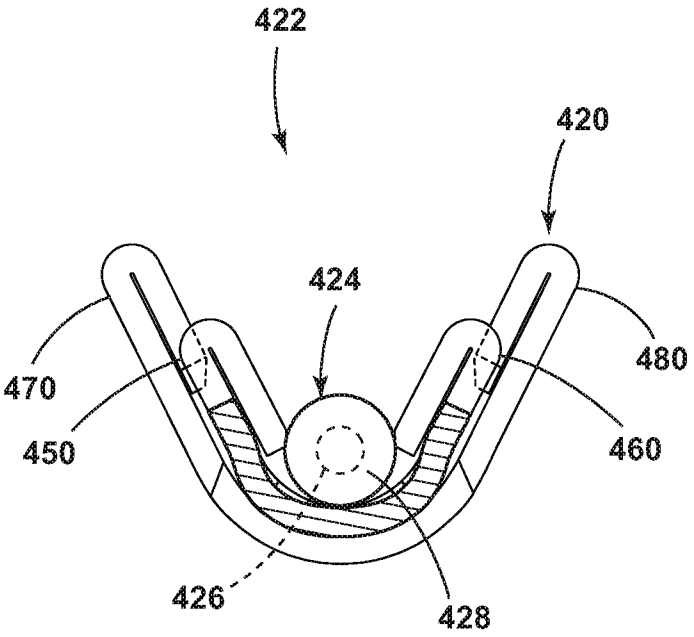
FIGS. 9A and 9B are cross-sectional views generally illustrating embodiments of a first terminal assembly with a first terminal in a bent state and a second terminal assembly with a second terminal in a bent state.
Figure 9A:
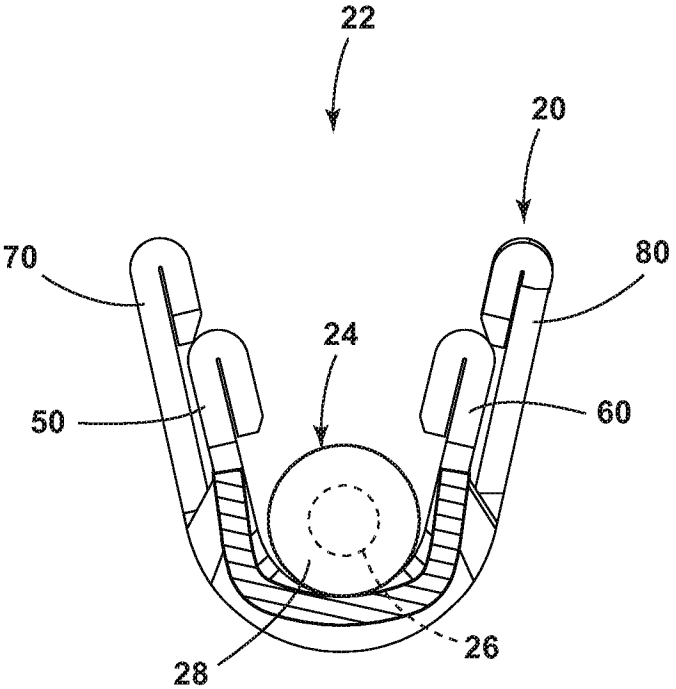

With embodiments, such as generally illustrated in FIGS. 9A and 9B, a first terminal assembly 22 may include a first terminal 20 and a wire 24, and a second terminal assembly 422 may include a second terminal 420 and a second wire 424. The second terminal 420 may include a first wing 450, a second wing 460, a third wing 470, and/or a fourth wing 480. In embodiments, a diameter of the wire 24 may be greater than a diameter of the second wire 424. The terminal assembly 22 may be substantially similar to the second terminal assembly 422 and/or include similar features. The lengths of the wings 50, 450, 60, 460 may be substantially the same. In embodiments, the lengths of the wings 70, 470, 80, 480 may be substantially the same. As the diameter of the second wire 424 is smaller than the diameter of the first wire 24, the wings 450, 460, 470, 480 may be bent to a greater degree than wings 50, 60, 70, 80. For example and without limitation, an effective length of the wings 450, 460, 470, 480 after bending may be shorter than an effective length of the wings 50, 60, 70, 80. Bending the wings 450, 460, 470, 480 to a greater degree may facilitate a better crimp connection with the smaller diameter wire 424. The terminal assembly 22 and/or terminal assembly 422 may retain (e.g., restrict movement in at least one direction) wires 24 and/or 424. The wire 424 may include a conductor 426 and an insulator 428. Bending terminals 20, 420 may permit use of terminals of the same original configuration (pre-bending and pre-crimping) with wires/cables of a wide variety of sizes while maintaining sufficient final crimp quality. Bending terminals 20, 420 may limit or prevent separating conductors 26, 426 of the same wire 24, 424 within the terminals 20, 420, during crimping which may facilitate a better electrical connection between the conductors 26, 426 and the terminal 20, 420. In contrast, using terminals of several different original configurations may complicate assembly, require additional handling processes, and/or involve greater costs, among other issues. In embodiments, the terminal 20 may include only one wing 50 to secure the conductor 26 and/or only one wing 70 to secure the insulator 28. When only one wing is used, it may include a length (e.g., in a vertical direction) longer than a length of wings when multiple wings are used to secure the conductor 26 and/or insulator 28. Such a single wing may bend such that the bent portion contacts an inner surface of the terminal body portion 40 and/or a respective connection portion. In embodiments, a terminal 20 may be used for mechanical connections, and/or a terminal 20 may not be limited to electrical applications.

Various embodiments are described herein for various apparatuses, systems, and/or methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments.

Reference throughout the specification to "various embodiments," "with embodiments," "in embodiments," or "an embodiment," or the like, means that a particular feature, structure, or characteristic described in connection with the embodiment is included in at least one embodiment. Thus, appearances of the phrases "in various embodiments," "with embodiments," "in embodiments," or "an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment/example may be combined, in whole or in part, with the features, structures, functions, and/or characteristics of one or more other embodiments/examples without limitation given that such combination is not illogical or non-functional. Moreover, many modifications may be made to adapt a particular situation or material to the teachings of the present disclosure without departing from the scope thereof.

It should be understood that references to a single element are not necessarily so limited and may include one or more of such element. Any directional references (e.g., plus, minus, upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of embodiments.

Joinder references (e.g., attached, coupled, connected, and the like) are to be construed broadly and may include intermediate members between a connection of elements and relative movement between elements. As such, joinder references do not necessarily imply that two elements are directly connected/coupled and in fixed relation to each other. The use of "e.g." in the specification is to be construed broadly and is used to provide non-limiting examples of embodiments of the disclosure, and the disclosure is not limited to such examples. Uses of "and" and "or" are to be construed broadly (e.g., to be treated as "and/or"). For example and without limitation, uses of "and" do not necessarily require all elements or features listed, and uses of "or" are intended to be inclusive unless such a construction would be illogical.

While processes, systems, and methods may be described herein in connection with one or more steps in a particular sequence, it should be understood that such methods may be practiced with the steps in a different order, with certain steps performed simultaneously, with additional steps, and/or with certain described steps omitted.

It is intended that all matter contained in the above description or shown in the accompanying drawings shall be interpreted as illustrative only and not limiting. Changes in detail or structure may be made without departing from the present disclosure.

What is claimed is:

1. A terminal, comprising:

a terminal body, and a first conductor wing extending from the terminal body, the first conductor wing including an end portion, a middle portion, and a connecting portion, a first insulator wing extending from the terminal body, the first insulator wing including an end portion, a middle portion, and a connecting portion, and wherein an inner surface of the end portion of the first conductor wing is in contact with an inner surface of the middle portion of the first conductor wing; an inner surface of the end portion of the first insulator wing is in contact with an inner surface of the middle portion of the first insulator wing; and the first conductor wing is offset from the first insulator wing in a longitudinal direction.

2. The terminal of claim 1, including a second conductor wing extending from the terminal body.

3. The terminal of claim 2, wherein an outer surface of the middle portion of the first conductor wing is in contact with an outer surface of the middle portion of the second conductor wing.

4. The terminal of claim 2, wherein the first conductor wing and the second conductor wing are disposed on opposite sides of the terminal body.

5. The terminal of claim 2, wherein the second conductor wing includes an end portion, a middle portion, and a connecting portion; and the connecting portion of the first conductor wing and the connecting portion of the second conductor wing are both connected to the terminal body.

6. The terminal of claim 2, wherein the first conductor wing, the second conductor wing, and the terminal body form a substantially closed first channel.

7. The terminal of claim 2, wherein the first conductor wing, the second conductor wing, and the terminal body are configured to retain at least a portion of a conductor; the first insulator wing, a second insulator wing, and the terminal body are configured to retain at least a portion of an insulator; and the insulator is connected to the conductor.

8. The terminal of claim 2, including a second insulator wing.

9. The terminal of claim 8, wherein the first conductor wing, the second conductor wing, and the terminal body form a substantially closed first channel; the first insulator wing, the second insulator wing, and the terminal body form a substantially closed second channel; and the substantially closed first channel and the substantially closed second channel both extend substantially along a longitudinal axis.

10. The terminal of claim 8, wherein the connecting portion of the first conductor wing and the connecting portion of the second conductor wing are disposed apart at a first distance, a connecting portion of the first insulator wing and a connecting portion of the second insulator wing are disposed apart at a second distance, and the first distance is less than the second distance.

11. An electrical assembly comprising:

an electrical wire, a terminal body, and a plurality of wings including a first wing, and a second wing, wherein the first wing includes a first bent portion, the second wing includes a second bent portion, the first wing and the second wing contact a bottom portion of the terminal body to form a channel, and at least one of the first bent portion and the second bent portion is crimped with the electrical wire.

12. The electrical assembly of claim 11, wherein the electrical wire is a stranded conductor, and the stranded conductor substantially fills the channel.

13. The electrical assembly of claim 12, wherein the first wing defines a first gap; the second wing defines a second gap; and no portion of the electrical wire is disposed within the first gap or the second gap.

14. The electrical assembly of claim 13, wherein the plurality of wings includes a third wing and a fourth wing; the third wing and the fourth wing are offset from each other in a longitudinal direction; and the third wing and the fourth wing retain an insulator of the electrical wire.

15. A method of assembling a terminal assembly, the method comprising:

providing a first terminal, the first terminal including a terminal body, a first wing, and a second wing, the first wing and the second wing each including an end portion, a middle portion, and a connecting portion;

providing a second terminal, the second terminal including a terminal body, a first wing, and a second wing, the first wing and the second wing of the second terminal each including an end portion, a middle portion, and a connecting portion;

bending the end portion of the first wing of the first terminal and the end portion of the second wing of the first terminal to provide a first bent portion and a second bent portion of the first terminal;

crimping the first bent portion and the second bent portion of the first terminal onto a first wire;

bending the end portion of the first wing of the second terminal and the end portion of the second wing of the second terminal to provide a first bent portion and a second bent portion of the second terminal; and crimping the first bent portion and the second bent portion of the second terminal onto a second wire; and wherein a diameter of the first wire is larger than a diameter of the second wire; and, prior to bending and crimping, the first terminal is substantially similar to the second terminal.

16. The method of claim 15, wherein bending the end portion of the first wing of the second terminal and the end portion of the second wing of the second terminal includes bending the end portion of the first wing of the second terminal and the end portion of the second wing of the second terminal to a greater degree than the bending of the end portion of the first wing and the end portion of the second wing of the first terminal.

17. The method of claim 15, wherein the first terminal includes a third wing and a fourth wing, the third wing and the fourth wing each including an end portion, a middle portion, and a connecting portion.

18. The method of claim 15, wherein bending the end portion of the first wing of the first terminal and the end portion of the second wing of the first terminal includes bending the end portion of the first wing of the first terminal and the end portion of the second wing of the first terminal via a bending die, the bending die including a plurality of recesses.

19. The method of claim 18, wherein the bending die includes a substantially flat bridge portion disposed between a first recess and a second recess of the plurality of recesses, and a width of the bridge portion is at least half as wide as the first recess and the second recess.

20. The method of claim 19, wherein the first recess and the second recess include a first portion and a second portion; the first portion of the first recess contacts the end portion of the first wing of the first terminal during bending; and the second portion of the second recess contacts the end portion of the second wing of the first terminal.

* * * * *